US011670213B2

(12) United States Patent
Yuan et al.

(10) Patent No.: US 11,670,213 B2
(45) Date of Patent: Jun. 6, 2023

(54) DISPLAY PANEL AND DRIVING METHOD THEREOF, AND DISPLAY DEVICE

(71) Applicant: BOE TECHNOLOGY GROUP CO., LTD., Beijing (CN)

(72) Inventors: Lijun Yuan, Beijing (CN); Can Zhang, Beijing (CN); Ning Cong, Beijing (CN); Can Wang, Beijing (CN); Jinfei Niu, Beijing (CN); Minghua Xuan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 13 days.

(21) Appl. No.: 17/613,985

(22) PCT Filed: Dec. 18, 2020

(86) PCT No.: PCT/CN2020/137566

§ 371 (c)(1),
(2) Date: Nov. 24, 2021

(87) PCT Pub. No.: WO2022/126587

PCT Pub. Date: Jun. 23, 2022

(65) Prior Publication Data

US 2022/0398965 A1 Dec. 15, 2022

(51) Int. Cl.
*G09G 3/20* (2006.01)
*G09G 3/3233* (2016.01)

(52) U.S. Cl.
CPC ..... *G09G 3/2074* (2013.01); *G09G 3/3233* (2013.01); *G09G 3/2003* (2013.01);
(Continued)

(58) Field of Classification Search
None
See application file for complete search history.

(56) References Cited

U.S. PATENT DOCUMENTS 6,222,512 B1 * 4/2001 Tajima ..... G09G 3/2029 345/63
2004/0222746 A1 * 11/2004 Winters ..... G09G 3/3233 315/169.3

(Continued)

FOREIGN PATENT DOCUMENTS

CN 1674072 A 9/2005
CN 1750100 A 3/2006

(Continued)

*Primary Examiner* — Dorothy Harris
(74) *Attorney, Agent, or Firm* — Houtteman Law LLC

(57) ABSTRACT

A display panel includes: a plurality of light emitting signal lines. Under a control of switching signals provided from a plurality of switching signal lines and control signals provided from a plurality of control signal lines, working gray scale level signals corresponding to respective display gray scales are written to corresponding sub-pixels in an order from small to large in working gray scale sequentially by a plurality of times in one frame display time through the plurality of light emitting signal lines. Different working gray scale level signals indicate have different durations, and each of the working gray scale level signals is provided to the organic light emitting diode via the second transistor through a light emitting signal line, and a final display gray scale is a gray scale caused by superimposing different working gray scale level signals.

20 Claims, 3 Drawing Sheets

(52) U.S. Cl.
CPC ..... *G09G 2300/0452* (2013.01); *G09G 2300/0842* (2013.01); *G09G 2310/0297* (2013.01); *G09G 2310/08* (2013.01); *G09G 2330/021* (2013.01)

(56) References Cited

U.S. PATENT DOCUMENTS

| | | | | |
|---|---|---|---|---|
| 2007/0046689 | A1* | 3/2007 | Tokimoto | G09G 3/32 345/589 |
| 2008/0231565 | A1* | 9/2008 | Hyeon | G09G 3/3233 345/82 |
| 2009/0302331 | A1* | 12/2009 | Smith | H01L 27/3216 257/E33.062 |
| 2015/0243210 | A1 | 8/2015 | Park et al. | |
| 2017/0039966 | A1* | 2/2017 | Xu | G09G 3/3648 |
| 2017/0092166 | A1* | 3/2017 | Choi | G09G 3/3225 |
| 2020/0127057 | A1* | 4/2020 | Yamashita | H01L 27/3213 |
| 2021/0057493 | A1* | 2/2021 | Liu | H01L 27/3211 |
| 2021/0134844 | A1* | 5/2021 | Liu | H01L 51/5275 |
| 2021/0158746 | A1* | 5/2021 | Li | G09G 3/3225 |

FOREIGN PATENT DOCUMENTS

| | | | |
|---|---|---|---|
| CN | 101178872 | A | 5/2008 |
| CN | 102163390 | A | 8/2011 |
| CN | 110459577 | A | 11/2019 |
| CN | 110632767 | A | 12/2019 |
| CN | 111312158 | A | 6/2020 |

* cited by examiner

DISPLAY PANEL AND DRIVING METHOD THEREOF, AND DISPLAY DEVICE

TECHNICAL FIELD

The present disclosure relates to the field of display technology, and in particular, to a display panel and a driving method thereof, and a display device.

BACKGROUND

Compared with a CTR (a Cathode Ray Tube) display or a TFT-LCD (a Thin Film Transistor Liquid Crystal Display), an OLED (an Organic Light Emitting Diode) display has advantages of lighter and thinner appearance, wider viewing angle, faster response speed, and lower power consumption, and thus has been gradually spotlighted as a next generation display device.

The mature semiconductor CMOS (Complementary Metal-Oxide-Semiconductor Transistor) technology is adopted in a silicon-based OLED display panel to integrate high-density and complex driving circuits on a mono-crystalline silicon (as an active driving backplane chip), and then the silicon-based OLED display panel is combined with an OLED, thereby providing a solution of a single-chip micro-display.

SUMMARY

According to one aspect of the present disclosure, a silicon-based organic light emitting diode display panel is provided, and the silicon-based organic light emitting diode display panel includes: a plurality of pixel islands, each of the plurality of pixel islands including a plurality of sub-pixels; a plurality of control signal lines; a plurality of switching signal lines; a plurality of light emitting signal lines; and respective sub-pixel driving circuits for the plurality of sub-pixels, wherein the plurality of pixel islands are arranged in multiple rows and multiple columns, the plurality of sub-pixels in each of the plurality of pixel islands are of a same color, one sub-pixel in each of the plurality of pixel islands together with two sub-pixels of different colors in at least two adjacent pixel islands in a row or a column direction constitutes one pixel unit for displaying, each of the sub-pixel driving circuits includes a first transistor, a second transistor and a first capacitor, a first electrode of the first transistor is connected to one of the plurality of switching signal lines, a second electrode of the first transistor is connected to a control electrode of the second transistor and a first terminal of the first capacitor, and a control electrode of the first transistor is connected to one of the plurality of control signal lines; a first electrode of the second transistor is connected to one of the plurality of light emitting signal lines, and a second electrode of the second transistor is connected to a first electrode of an organic light emitting diode to be driven; and a second terminal of the first capacitor is connected to a common voltage terminal, and under a control of switching signals provided from the plurality of switching signal lines and control signals provided from the plurality of control signal lines, working gray scale level signals corresponding to respective display gray scales are written to corresponding sub-pixels in an order from small to large in working gray scale sequentially by a plurality of times in one frame display time through the plurality of light emitting signal lines, wherein different working gray scale level signals indicate that the different working gray level signals have different durations, and each of the working gray scale level signals is provided to the organic light emitting diode via the second transistor through a light emitting signal line, and a final display gray scale of each of the plurality of sub-pixels in the plurality of pixel islands is a gray scale superimposed by the different working gray scale level signals.

Optionally, one first sub-pixel in each of the plurality of pixel islands is located at the same position in the pixel island as a second sub-pixel and a third sub-pixel of different colors respectively in at least two adjacent pixel islands in the row or column direction, so as to constitute one pixel unit.

Optionally, a distance between every two adjacent sub-pixels in the plurality of sub-pixels in each of the plurality of pixel islands is smaller than a distance between every two adjacent pixel islands in the plurality of pixel islands.

Optionally, a sub-pixel in each of the plurality of pixel islands further includes the organic light emitting diode, the organic light emitting diode is provided with the first electrode, a light emitting functional layer, and a second electrode sequentially arranged on a side of the sub-pixel driving circuit away from a silicon substrate, and the first electrodes of the organic light emitting diodes of the sub-pixels in each of the plurality of pixel islands are spaced apart from each other by a distance in a range of 0.8 μm to 1.2 μm.

Optionally, the distance between two adjacent pixel islands in the plurality of pixel islands is in a range of 20 μm to 24 μm.

Optionally, each of the plurality of sub-pixels in the plurality of pixel islands has a size less than or equal to 3 μm*3 μm.

Optionally, the plurality of pixel islands at least include pixel islands of three different colors which have red sub-pixels, blue sub-pixels and green sub-pixels, respectively, and the pixel islands of the three different colors are sequentially arranged in the row direction, and the pixel islands of the same color are sequentially arranged in the column direction.

Optionally, the first electrodes of the second transistors in the plurality of sub-pixels in each of the plurality of pixel islands are respectively connected in parallel to a same light emitting signal line, and different pixel islands of the plurality of pixel islands are connected to different light emitting signal lines, respectively.

Optionally, the display panel further includes at least one light emitting signal bus line connected to the plurality of light emitting signal lines through a plurality of first gating switches, respectively.

Optionally, the display panel further includes a plurality of first gating lines connected to the plurality of first gating switches respectively, to control tune-on and turn-off of the plurality of first gating switches, respectively.

Optionally, the display panel further includes a plurality of second gating switches, wherein the plurality of light emitting signal lines are connected to the at least one light emitting signal bus line through one of the plurality of second gating switches and one of the plurality of first gating switches respectively, one of the plurality of first gating switches is between the at least one light emitting signal bus line and one of the plurality of second gating switches, and one of the plurality of first gating switches is connected to multiple light emitting signal lines connected to the pixel islands in one column in the plurality of pixel islands arranged in multiple rows and multiple columns through corresponding second gating switches, respectively.

Optionally, the display panel further includes a plurality of second gating lines connected to the plurality of second gating switches in a one-to-one correspondence respectively, to control turn-on and turn-off of the plurality of second gating switches, respectively.

Optionally, the plurality of control signal lines extend in the row direction, the plurality of switching signal lines extend in the column direction, the plurality of control signal lines cross over the plurality of switching signal lines to form a plurality of intersection regions in which the plurality of sub-pixels in the plurality of pixel islands are respectively located, and the plurality of control signal lines are configured to provide driving signals to multiple sub-pixel rows, respectively, and the plurality of switching signal lines are configured to provide switching signals to multiple sub-pixel columns, respectively.

According to one aspect of the present disclosure, a display device is provided, and the display device includes the above display panel and a driving circuit for driving the display panel.

According to one aspect of the present disclosure, a method for driving the display panel is provided, and the method includes: sequentially providing the control signals to sub-pixel rows in a plurality of pixel islands through the plurality of control signal lines respectively, and sequentially providing the switching signals to sub-pixel columns in the plurality of pixel islands through the plurality of switching signal lines respectively; and under a control of the switching signals provided from the plurality of switching signal lines and the control signals provided from the plurality of control signal lines, writing the working gray scale level signals corresponding to respective display gray scales to corresponding sub-pixels in an order from small to large in working gray scale sequentially by a plurality of times in one frame display time through the plurality of light emitting signal lines, different working gray scale level signals indicate that the different working gray scale level signals have different durations, and each of the working gray scale level signals is provided to the organic light emitting diode via the second transistor through a light emitting signal line, and the final display gray scale of each of the plurality of sub-pixels in the plurality of pixel islands is a gray scale superimposed by the different working gray scale level signals.

Optionally, the number of light emitting gray scale levels of each of the plurality of sub-pixels in the plurality of pixel islands is expressed as:

$$K=2^p$$

wherein K represents the number of the light emitting gray scale levels of a sub-pixel, p represents the number of working gray scale level signals input to the sub-pixel, and p is an integer larger than or equal to 0.

Optionally, the writing the working gray scale level signals corresponding to respective display gray levels to corresponding sub-pixels in an order from small to large in working gray scale sequentially by a plurality of times in one frame display time includes: inputting the working gray scale level signals to the sub-pixels in the display panel in an order from small to large in working gray scale by a plurality of times, in each of which a working gray scale of M powers of 2 in the light emitting gray scale levels of $2^p$ is input where M is a integer from 0 to p−1, and controlling whether or not the working gray scale level signals are written into corresponding sub-pixels by the switching signals provided from the plurality of switching signal lines.

Optionally, gray scales of non-power of 2 in the light emitting gray scale levels of $2^p$ and gray scales greater than a maximum gray scale in the light emitting gray scale levels of $2^p$ are acquired by superimposing gray scales which are lower than a desired gray scale and the gray scales of power of 2 in the light emitting gray scale levels of $2^p$.

Optionally, the method further includes: selecting p, and defining a period which includes a total duration time for sequentially inputting all the working gray scale level signals in an order from small to large in working gray scale based on the light emitting gray scale levels of the selected p, and circularly inputting the working gray level signals of a plurality of periods to the corresponding sub-pixels to acquire the required gray scale.

Optionally, p=4.

BRIEF DESCRIPTION OF THE DRAWINGS

In order to more clearly illustrate the technical solutions of the embodiments of the present disclosure, the drawings used in the embodiments or the related technical descriptions will be briefly introduced below, and it is obvious that the drawings in the following description only relate to some embodiments of the present disclosure and do not limit the present disclosure.

DETAILED DESCRIPTION

To make the objects, technical solutions and advantages of the embodiments of the present disclosure more apparent, the technical solutions of the embodiments of the present disclosure will be clearly and completely described below with reference to the drawings of the embodiments of the present disclosure.

The most obvious difference between a silicon-based OLED display panel and a common OLED display panel is that the silicon-based OLED display panel does not include a bottom glass plate but includes a silicon chip. The silicon-based OLED display panel is mainly manufactured by using IC (integrated circuit) manufacturing technology and OLED technology. Unlike a traditional mobile phone, a computer or a television, the silicon-based OLED display panel has a diagonal of a pixel of generally less than 2 inches, and a pixel density of more than 1500PPI (pixels per inch).

Thus, according to an aspect of the present disclosure, a silicon-based organic light emitting diode display panel is provided. The silicon-based organic light emitting diode display panel includes: a plurality of pixel islands, each of the plurality of pixel islands including a plurality of sub-pixels; a plurality of control signal lines; a plurality of switching signal lines; a plurality of light emitting signal lines; and respective sub-pixel driving circuits for the plurality of sub-pixels.

Figure 1:
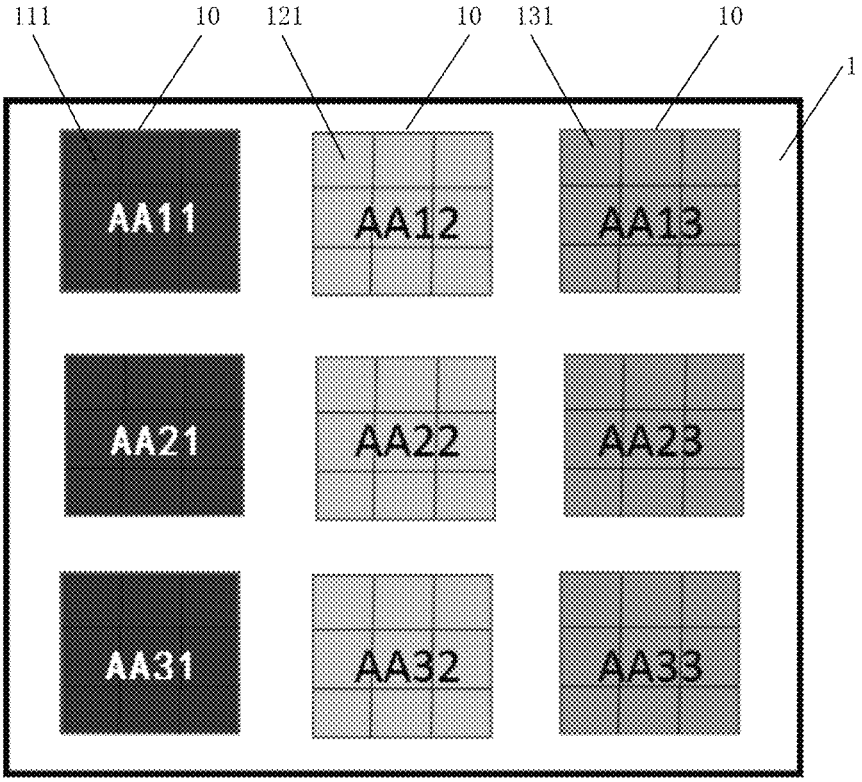
FIG. 1 is a schematic diagram illustrating a layout of pixel islands in a silicon-based OLED display panel according to an embodiment of the present disclosure.

FIG. 1 is a schematic diagram illustrating a layout of pixel islands in a silicon-based OLED display panel according to an embodiment of the present disclosure. As shown in FIG. 1, a plurality of pixel islands 10 (AA11, AA12, AA13, AA21, AA22, AA23, AA31, AA32, and AA33) are on a base 1 and arranged in multiple rows and multiple columns. Each of the plurality of pixel islands 10 includes a plurality of sub-pixels (e.g., a sub-pixel 111, a sub-pixel 121, and a sub-pixel 131). The plurality of sub-pixels in each of the plurality of pixel islands 10 emit light of a same color, e.g., each of the sub-pixels in the pixel islands AA11, AA21 and AA31 emits light of red color, each of the sub-pixels in the pixel islands AA12, AA22 and AA32 emits light of green color, and each of the sub-pixels in the pixel islands AA13, AA23, and AA33 emits light of blue color.

One sub-pixel in each of the plurality of pixel islands 10 constitutes one pixel unit with sub-pixels of different colors in at least two adjacent pixel islands 10 in a row direction (a first direction D1) or in a column direction (a second direction D2). As shown in FIG. 1, two adjacent pixel islands 10 in the row direction (the first direction D1) are of different colors, for example, the red sub-pixel 111 in the pixel island AA11, the green sub-pixel 121 in the pixel island AA12, and the blue sub-pixel 131 in the pixel island AA13 constitute one pixel unit. The pixel unit constituted of the red sub-pixel 111, the green sub-pixel 121, and the blue sub-pixel 131 may perform display under the driving of a plurality of control signal lines, a plurality of switching signal lines, and a plurality of light emitting signal lines.

Figure 2:
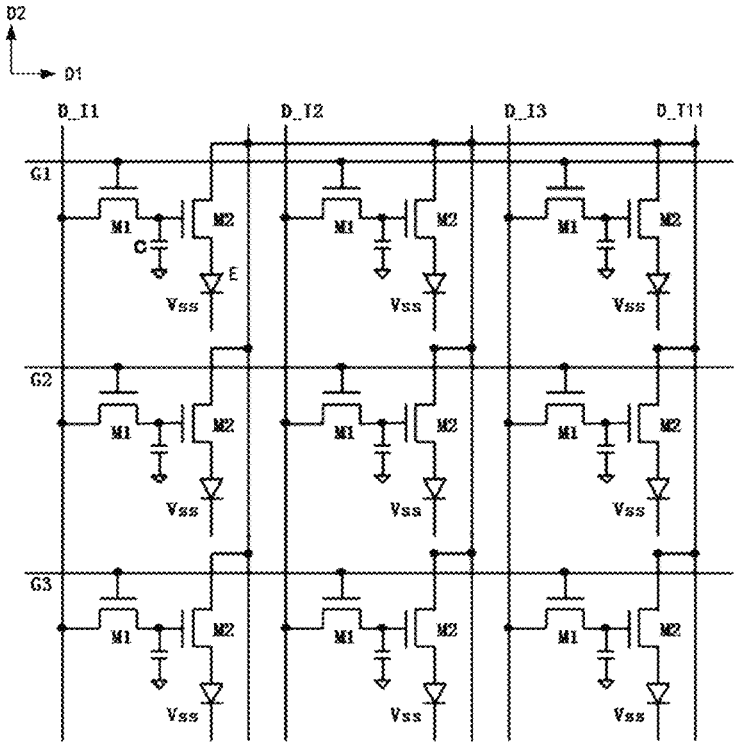
FIG. 2 is a schematic diagram of a sub-pixel driving circuit according to an embodiment of the present disclosure.

FIG. 2 is a schematic diagram illustrating a sub-pixel driving circuit according to an embodiment of the present disclosure, which illustrates driving circuits for nine sub-pixels for example in one pixel island AA11. As shown in FIG. 2, one of the sub-pixel driving circuits includes: a first transistor M1, a second transistor M2 and a storage capacitor C (i.e., a first capacitor). A control electrode of the first transistor M1 is connected to one of the plurality of control signal lines (G1, G2, G3 . . . ), a first electrode of the first transistor M1 is connected to one of the plurality of switching signal lines (D_I1, D_I2, D_I2 . . . ), and a second electrode of the first transistor M1 is connected to a control electrode of the second transistor M2 and a first terminal of the first capacitor C. A first electrode of the second transistor M2 is connected to one (D_T11) of the plurality of light emitting signal lines (D_T11, D_T12, D_T13, D_T21, D_T22, D_T23, D_T31, D_T32, and D_T33 . . . ), and a second electrode of the second transistor M2 is connected to a first electrode (an anode) of an organic light emitting diode E to be driven. A second terminal of the storage capacitor C is connected to a common voltage terminal. A second electrode (a cathode) of the organic light emitting diode E is connected to a first voltage terminal VSS.

In the present disclosure, working gray scale level signals corresponding to respective display gray scales are written to corresponding sub-pixels in such a manner in which the working gray scale level signal of a small level is written before the working gray scale lever signal of a large level so that the working gray scale level signals are written in an order from small to large in working gray scale sequentially by one or a plurality of times (corresponding to one or a plurality of working gray scale cycles (or periods), and one working gray scale cycle including all the gray scales corresponding to integral power of 2 in a case of a predetermined integer, its power exponent is a integer smaller than the predetermined integer and larger or equal to zero) in one frame display time through the plurality of light emitting signal lines, under control of switching signals provided from the plurality of switching signal lines and control signals provided from the plurality of control signal lines. Different working gray scale level signals indicate that the different working gray scale level signals have different durations and a substantially same current, and each of the working gray scale level signals is provided to the organic light emitting diode via the second transistor through a light emitting signal line. A final display gray scale of each of the plurality of sub-pixels in the plurality of pixel islands is a gray scale caused by superimposing different working gray scale level signals. That is, in the one frame display time, for example, the working gray scale level signals (to be accumulated) corresponding to the respective display gray scales are sequentially written to the corresponding sub-pixels in the order from small to large in working gray scale, such as working gray scale 1, working gray scale 2, working gray scale 4 (a gray scale of an integral power of 2) . . . , and so on. Different working gray scales correspond to different durations of the working gray scale level signals for the sub-pixels. For example, the duration of a working gray scale level signal corresponding to the working gray scale 1 of a sub-pixel is one unit, and the duration of a working gray scale level signal corresponding to the working gray scale 2 of a sub-pixel is two units. The final display gray scale of each of the sub-pixels is a gray scale of a superimposed single display gray scale obtained by superimposing the different working gray scale level signals which are written to the sub-pixel during the one frame display time. For example, the working gray scale level signals corresponding to the working gray scale 1 and the working gray scale 2 are sequentially input to one sub-pixel by two times to obtain a final display gray scale 3 by superimposing the working gray scale level signals respectively corresponding to the working gray scale 1 and the working gray scale 2. For example, the working gray scale level signals corresponding to the working gray scale 1 and the working gray scale 4 are sequentially input to one sub-pixel by two times to obtain a final display gray scale 5 by superimposing the working gray scale level signals respectively corresponding to the working gray scale 1 and the working gray scale 4, and in the process, when the working gray scale level signal corresponding to the working gray scale 2 is output through the light emitting signal line, the working gray scale level signal corresponding to the working gray scale 2 is optionally not input to the one sub-pixel.

That is to say, the working gray scale level signals corresponding to the working gray scales 1, 2 and 4 are output sequentially to the sub-pixel through the light emitting signal line. Under the control of the switching signals provided from the switching signal lines and the control signals provided from the control signal lines, the working gray scale level signal corresponding to the working gray scale 1 may be input to the sub-pixel, the working gray scale level signal corresponding to the working gray scale 2 may not be input to the sub-pixel, and the working gray scale level signal corresponding to the working gray scale 4 may be input to the sub-pixel, so that the final display gray scale 5 is obtained. In the process of inputting the working gray scale level signals corresponding to the working gray scales to the sub-pixels, the switching signals provided from the plurality of switching signal lines are required to enable the working gray scale level signals of different durations corresponding to different gray scales to be input to corresponding sub-pixels, that is, the switching signals are required to be large or small enough to ensure that the turned-on duration of the second transistor M2 meets the required duration of the working gray scale level signal corresponding to the required working gray scale. The operating principle of the sub-pixel circuit will be described below.

In the present disclosure, the process difficulty may be reduced by providing a plurality of sub-pixels of a same color in a same pixel island, which can also reduce the distance between a plurality of sub-pixels in the same pixel island as much as possible and constitute a pixel unit with sub-pixels in adjacent pixel islands with different colors for displaying. Compared with a pixel unit constituted of three independent sub-pixels in the related art, in a case where the same number of pixel units are provided, the present disclosure can significantly reduce the area occupied by the same number of pixel units, thereby increasing the PPI of the display panel.

Optionally, as shown in FIG. 1, the plurality of sub-pixels in each of the plurality of pixel islands 10 are arranged in multiple rows and multiple columns, and the number, size, and positional layout of the plurality of sub-pixels in each of the plurality of pixel islands are the same. For example, each of the plurality of pixel islands AA11 to AA33 is in a form of a matrix 3*3 including 9 sub-pixels, and the size of each of the sub-pixels and the positional relationship of the plurality of sub-pixels with respect to each other in each of the pixel islands are the same. It is advantageous for reducing the process difficulty of the display panel.

Optionally, one first sub-pixel in each of the plurality of pixel islands 10 is located at the same position in a corresponding pixel island as the second and third sub-pixels of different colors in at least two adjacent pixel islands along the row direction or the column direction to constitute one pixel unit. As shown in FIG. 1, the first sub-pixel 111 in the pixel island AA11, together with the second sub-pixel 121 at the same position in the pixel island AA12 and the third sub-pixel 131 at the same position in the pixel island AA13, may constitute one pixel unit. Sub-pixels elsewhere in the pixel island AA11, together with the second sub-pixels 121 at the same position in the pixel island AA12 and the third sub-pixels 131 at the same position, may constitute other pixel units. Thus, the pixel island AA11, the pixel island AA12 and the pixel island AA13 may form nine pixel units. Compared with nine pixel units each formed by three independent sub-pixels in the related art, the nine sub-pixels of the same color in the present disclosure are arranged in a space smaller than that of the three sub-pixels in the related art, so that the occupied area can be reduced, and the PPI of the display panel is increased. Moreover, since the arrangement and the space between the sub-pixels in each of the 9 pixel units formed by the pixel island AA11, the pixel island AA12 and the pixel island AA13 are the same, the present disclosure is also beneficial for displaying a picture.

Optionally, in a case where a plurality of sub-pixels of a same color are provided compactly together to form a pixel island, a distance between the sub-pixels adjacent to each other in the plurality of sub-pixels in each of the plurality of pixel islands 10 is smaller than a distance between the pixel islands adjacent to each other in the plurality of pixel islands, as shown in FIG. 1. Optionally, the distance between the sub-pixels adjacent to each other in the plurality of sub-pixels in each of the plurality of pixel islands may be as close to zero as possible based on a manufacturing process, so as to make the plurality of sub-pixels in the pixel island as compact as possible. In the present disclosure, the sub-pixel in each of the plurality of pixel islands includes an organic light emitting diode E, and the organic light emitting diode E is provided with a first electrode, a light emitting functional layer, and a second electrode sequentially arranged on a side of the sub-pixel driving circuit away from a silicon substrate. First electrodes of organic light emitting diodes of the sub-pixels in each of the plurality of pixel islands are spaced apart from each other and have a distance in a range of 0.8 μm to 1.2 μm from each other, for example, 0.9 μm, 1.0 μm, or 1.1 μm. Second electrodes of the organic light emitting diodes of the plurality of sub-pixels in the plurality of pixel islands may be formed as a single piece to cover the entire display panel. Moreover, the distance between the first electrodes of the organic light emitting diodes may be made as small as possible based on the manufacturing process.

Optionally, the distance between the pixel islands adjacent to each other in the plurality of pixel islands 10 is in a range of 20 μm to 24 μm, and may be, for example, 21 μm, 22 μm, 23 μm, and the like. Optionally, each of the plurality of sub-pixels in the plurality of pixel islands may have a size, for example, less than or equal to 3 μm*3 μm, for example, 2.4 μm*2.4 μm, and specifically may have a smallest sub-pixel size made by a process employed.

Optionally, as shown in FIG. 1, the plurality of pixel islands 10 may include at least pixel islands of three different colors of the red sub-pixel, the blue sub-pixel and the green sub-pixel. The three pixel islands of different colors are sequentially arranged along the first direction D1, the pixel islands of the same color are sequentially arranged along the second direction D2, and the first direction D1 is perpendicular to the second direction D2, so that the plurality of pixel islands are arranged in multiple rows and multiple columns. Thus, when one pixel unit is formed by combination, the sub-pixels of corresponding colors may be selected from the adjacent pixel islands of three colors. The pixel islands of three different colors in the first direction D1 are regarded as a group, and the sub-pixels are selected therefrom to constitute the pixel units. FIG. 1 merely shows that one pixel unit is composed of three sub-pixels of different colors, but the present disclosure is not limited thereto. For example, one pixel unit may be composed of a red sub-pixel, a blue sub-pixel, a green sub-pixel, and a white sub-pixel, and pixel islands of corresponding colors may be provided.

Optionally, first electrodes of second transistors M2 in the plurality of sub-pixels in each of the plurality of pixel islands 10 are respectively connected to a same light emitting signal line in parallel. As shown in FIG. 2, the first electrodes of the second transistors M2 in the nine sub-pixels in the pixel island AA11 each are connected to the same light emitting signal line D_T11.

Figure 3:
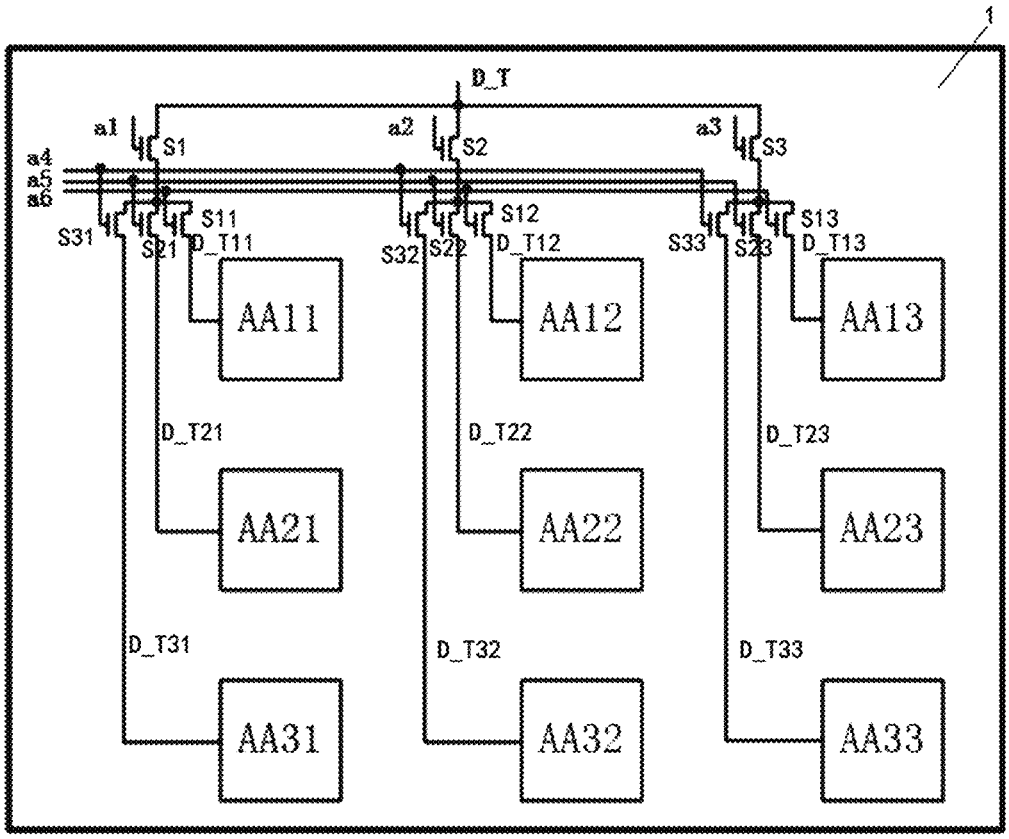
FIG. 3 illustrates a layout of signal lines for display driving according to an embodiment of the present disclosure.

Optionally, different pixel islands in the plurality of pixel islands are respectively connected to different light emitting signal lines. FIG. 3 illustrates a layout of signal lines for display driving according to an embodiment of the present disclosure. As shown in FIG. 3, the pixel island AA11 is connected to the light emitting signal line D_11, the pixel island AA12 is connected to the light emitting signal line D_12, the pixel island AA13 is connected to the light emitting signal line D_T13, the pixel island AA21 is connected to the light emitting signal line D_21, the pixel island AA22 is connected to the light emitting signal line D_T22, the pixel island AA23 is connected to the light emitting signal line D_T23, the pixel island AA31 is connected to the light emitting signal line D_T31, the pixel island AA32 is connected to the light emitting signal line D_T32, and the pixel island AA33 is connected to the light emitting signal line D_T33. That is, the plurality of sub-pixels in each of the pixel islands may be connected to the same light emitting signal line, and the plurality of sub-pixels in different pixel islands may be connected to different light emitting signal lines, so that whether to provide a display driving signal to a certain pixel island may be achieved by controlling a corresponding light emitting signal line, and then an intelligent view (a SmartView) display may be achieved by controlling whether to normally write a light emitting signal, thereby reducing power consumption. Different light emitting signals may be controlled through corresponding switches to determine whether the light emitting signals are written normally from the outside.

Optionally, the display panel further includes at least one light emitting signal bus line D_T connected to the plurality of light emitting signal lines (D_T11, D_T12, D_T13, D_T21, D_T22, D_T23, D_T31, D_T32 and D_T33 . . . ) through a plurality of first gating switches (e.g., S1, S2, S3 . . . ), respectively, as shown in FIG. 3. In this way, display driving signals may be provided to the plurality of light emitting signal lines, respectively, through the at least one light emitting signal bus line D_T controlled via the plurality of first gating switches.

Optionally, the display panel further includes a plurality of first gate lines (e.g., a1, a2, a 3) respectively connected to the plurality of first gating switches to respectively control closing (turn-on) and opening (turn-off) of the plurality of first gating switches, as shown in FIG. 3.

Optionally, the display panel further includes a plurality of second gate lines (e.g., a4, a5, a 6) and a plurality of second gating switches (e.g., S11, S12, S13 . . . ), as shown in FIG. 3. The plurality of second gate lines are respectively connected to the plurality of second gating switches in a one-to-one correspondence, so as to respectively control closing and opening of the plurality of second gating switches. The plurality of light emitting signal lines are connected to the at least one light emitting signal bus line D_T through one of the plurality of second gating switches and one of the plurality of first gating switches, respectively. Optionally, as shown in FIG. 3, one of the plurality of first gating switches is between the at least one light emitting signal bus line and one of the plurality of second gating switches, and the number of the plurality of first gating switches is smaller than the number of the plurality of second gating switches. For example, the number of the plurality of second gating switches may be equal to the number of pixel islands in the display panel, and the number of the plurality of first gating switches may be equal to the number of pixel island columns in the display panel. That is, the connection between the at least one light emitting signal bus line and the light emitting signal lines corresponding to one column of pixel islands may be controlled by one first gating switch.

The plurality of first gating switches and the plurality of second gating switches may be transistors, the plurality of first gate lines are respectively connected to control electrodes (i.e., gate electrodes) of corresponding transistors as the first gating switches, and the plurality of second gate lines are respectively connected to control electrodes of corresponding transistors as the second gating switches, thereby controlling the turn-on and turn-off of the corresponding transistors.

Optionally, as shown in FIG. 1, the plurality of control signal lines extend in the first direction D1, the plurality of switching signal lines extend in the second direction D2, and the plurality of control signal lines cross over the plurality of switching signal lines to form a plurality of intersection regions. The plurality of sub-pixels in the plurality of pixel islands are respectively in the plurality of intersection regions. The plurality of control signal lines are configured to respectively provide driving signals to multiple sub-pixel rows, and the plurality of switching signal lines are configured to respectively provide switching signals to multiple sub-pixel columns.

In the present disclosure, a high resolution of the display panel can be achieved by the above-described arrangement of the pixel islands and the pixel units. In addition, since the sub-pixel of the silicon-based OLED display panel in the present disclosure has a size smaller than that of the conventional display panel, the power consumption can be greatly reduced, and the brightness of the display panel may be improved.

According to another aspect of the present disclosure, a display device is provided. The display device may include any one of the display panels described above, and a driving circuit for driving the display panel. Since the display device adopts the display panel described above, high resolution, high brightness and low power consumption of the display device can be realized.

Figure 4:
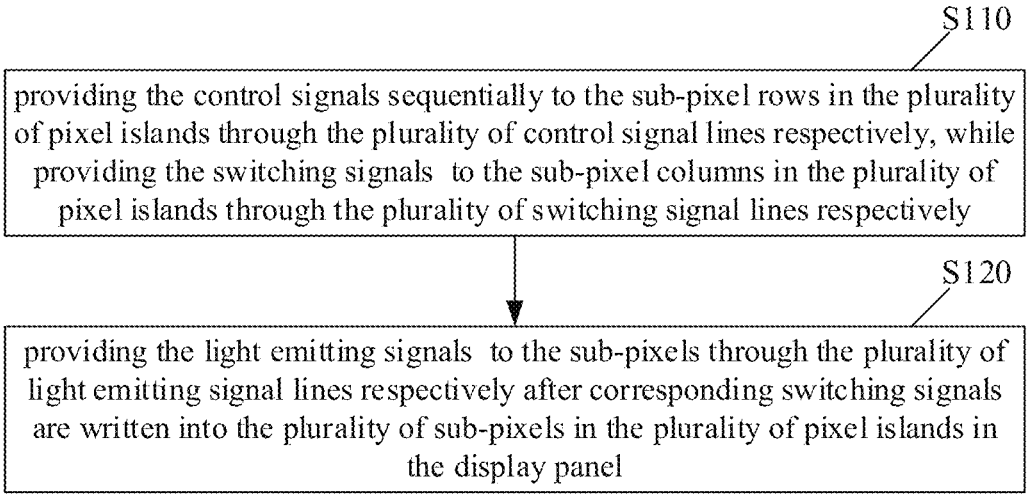
FIG. 4 is a flow chart for driving a silicon-based OLED display panel according to an embodiment of the present disclosure.
Figure 5:
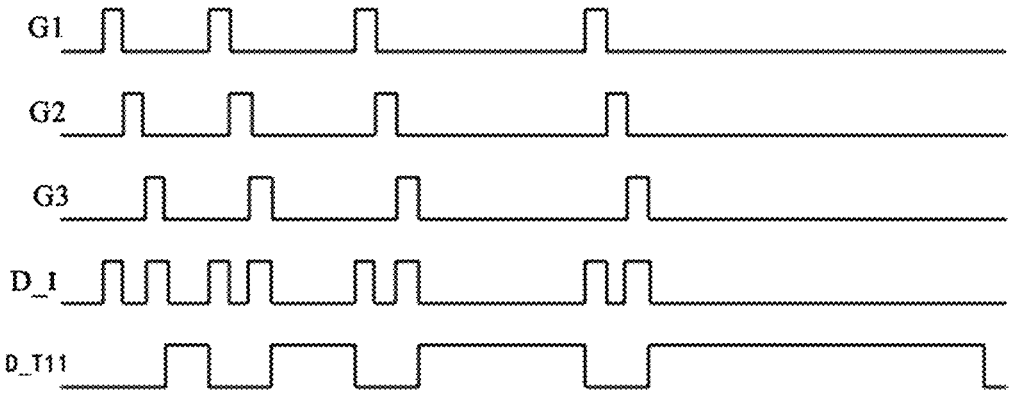
FIG. 5 is a timing diagram for driving a silicon-based OLED display panel according to an embodiment of the present disclosure.

According to another aspect of the present disclosure, a method for driving the above display panel is further provided. FIG. 4 is a flow chart for driving a silicon-based OLED display panel according to an embodiment of the present disclosure, and FIG. 5 is a timing diagram for driving a silicon-based OLED display panel according to an embodiment of the present disclosure. The driving method of the present disclosure is described in detail below with reference to FIGS. 1, 4, and 5.

As shown in FIG. 4, the driving method includes the following steps S110 and S120.

First, in step S110, the control signals are sequentially provided to the sub-pixel rows in the plurality of pixel islands through the plurality of control signal lines, respectively, while the switching signals are provided to the sub-pixel columns in the plurality of pixel islands through the plurality of switching signal lines, respectively. Specifically, the control signals are sequentially provided to the sub-pixel rows in the plurality of pixel islands through the plurality of control signal lines (G1, G2, G3 . . . ), respectively. For example, a control signal is provided to a first row of sub-pixels in the first row of pixel islands through the control signal line G1, so that the first transistors M1 in the sub-pixel driving circuits in the first row of sub-pixels are turned on. Meanwhile, the switching signals are provided to the sub-pixel columns in the plurality of pixel islands through the plurality of switching signal lines (D_I1, D_I2, D_I3 . . . ), respectively. Then, a control signal is provided to a second row of sub-pixels in the first row of pixel islands through the control signal line G2, so that the first transistors M1 in the sub-pixel driving circuits in the second row of sub-pixels are turned on. Meanwhile, the switching signals are provided to the sub-pixel columns in the plurality of pixel islands through the plurality of switching signal lines (D_I1, D_I2, D_I3 . . . ), respectively. This process is repeated until the switching signals required for all the sub-pixels are stored in the storage capacitors C of corresponding sub-pixels. As shown in FIG. 5, in the present disclosure, the embodiment is described by taking an example in which the switching signal of a high level is taken as an active signal. For example, when the control signal is provided to the first row of sub-pixels in the first row of pixel islands through the control signal line G1, the first transistors M1 are turned on, and meanwhile, high level signals are output through the switching signal lines D_I. The high level signals may be stored in the storage capacitors C via the first transistors M1, thereby turning on the second transistors M2. When the second transistors M2 are turned on, the working gray scale level signals of corresponding gray scales may be input to corresponding sub pixels in the first row through the light emitting signal lines D_T11. When a control signal is provided to the second row of sub-pixels in the first row of pixel islands through the control signal line G2, the first transistors M1 are turned on, and meanwhile, low level signals are output through the switching signal lines D_I. The low level signals may be stored in the storage capacitors C through the first transistors M1, thereby turning off the second transistors M2. When the second transistor M2 is turned off, it represents that the working gray scale level signal of a corresponding gray scale output through the light emitting signal line D_T11 cannot reach the corresponding sub pixel in the second row. In this way, whether or not the working gray scale level signals of corresponding gray scales output through the light emitting signal line D_T11 are input to corresponding sub-pixels may be controlled by the switching signals provided from the plurality of switching signal lines.

Next, in step S120, the light emitting signals are provided to the sub-pixels through the plurality of light emitting signal lines, respectively. Specifically, based on the display gray scale to be displayed of the sub-pixels in the picture to be displayed, a combination of low working gray scales required is determined based on the following formula (1) and p when the final display gray scale to be displayed of the sub-pixels is displayed. Then, the low working gray scales required are sequentially input to the sub-pixels of the display panel in the order from small to large in working gray scale through the light emitting signal lines. Based on the combination of low working gray scales required when the display gray scales to be displayed of the sub-pixels are displayed, under the control of the switching signals provided from the switching signal lines and the control signals provided from the control signal lines, the working gray scale level signals of corresponding durations corresponding to the low working gray scales are selectively allowed to reach corresponding sub-pixels through the second transistors M2 (i.e., by controlling whether to turn on or turn off the second transistors M2), until the sub-pixels acquire the working gray scales in the combination of low working gray scales required when the display gray scale to be displayed is displayed.

Optionally, the number of light emitting gray scale levels of each of the plurality of sub-pixels of the plurality of pixel islands is expressed as:

$$K=2^p \tag{1}$$

where K represents the number of the light emitting gray scale levels of the sub-pixel, p represents the number of working gray scale level signals input to the sub-pixel, and p is an integer larger than or equal to 0. For example, if p=4, K=16, it means that there are four working gray scale level signals corresponding to working gray scales 1, 2, 4 and 8 (calculated by $2^0$, $2^1$, $2^2$, and $2^3$), respectively, and sixteen light emitting gray scale levels, such as 0, 1, 2, 3, 4, 5, 6, 7, 8, 9, 10, 11, 12, 13, 14, and 15, may be output. Light emitting gray scale level 0 represents that no working gray scale level signal is input to the sub-pixel. Working gray scale 1 corresponds to a working gray scale level signal of one unit duration output from the light emitting signal line, working gray scale 2 corresponds to a working gray scale level signal of two unit durations output from the light emitting signal line, working gray scale 4 corresponds to a working gray scale level signal of four unit durations output from the light emitting signal line, working gray scale 8 corresponds to a working gray scale level signal of eight unit durations output from the light emitting signal line, and the ratio among the durations of working gray scale 1, working gray scale 2, working gray scale 4 and working gray scale 8 may be represented as 1:2:4:8, as shown in the light emitting signal line D_T11 in FIG. 5. Other light emitting display gray scale levels may be obtained by superimposing working gray scale 1, working gray scale 2, working gray scale 4, and working gray scale 8 by one or more times. For example, light emitting gray scale 15 may be obtained by superimposing working gray scale 1, working gray scale 2, working gray scale 4, and working gray scale 8.

Optionally, the process that the working gray scale level signals corresponding to respective working gray levels are written to corresponding sub-pixels sequentially in an order from small to large in working gray scale by a plurality of times in one frame of display time, includes: sequentially inputting working gray scale level signals corresponding to the working gray scales to the sub-pixels on the display panel in an order from small to large in working gray scale by a plurality of times in each of which a working gray scale of M powers of 2 in the light emitting gray scale levels of $2^p$ is input where M is a integer from 0 to p−1, and controlling whether or not the working gray scale level signals are input to corresponding sub-pixels by the switching signals provided from the plurality of switching signal lines. As described above, the working gray level signals corresponding to working gray scale 1 and working gray scale 4 are sequentially input to a sub-pixel respectively (i.e., by two times, working gray scale 1 by one time and working gray scale 4 by one time) to obtain a gray scale 5. Specifically, in the process of sequentially inputting the working gray levels 1, 2, and 4 through the light emitting signal line, when the working gray scale level signal corresponding to working gray level 2 is input, the second transistor M2 is turned off by the control of the switching signal, so that the working gray scale level signal corresponding to working gray level 2 is not input to the sub-pixel, but only the working gray scale level signals corresponding to the working gray levels 1 and 4 are input to the sub-pixel.

Optionally, p is selected, and a period which includes a total duration time for inputting all the different working gray scale level signals, which are sequentially and continuously input in an order from small to large in working gray scale based on the light emitting gray scale levels of the selected p, and the working gray scale level signals of a plurality of periods are circularly input to the corresponding sub-pixels to obtain the required gray scale level. For example, if p=4, K=16, which indicates that there are four working gray scale level signals corresponding to working gray scales 1, 2, 4 and 8, respectively, and sixteen light emitting gray scale levels, such as 0, 1, 2, 3, 4, 5, 6, 7, 8, 9, 10, 11, 12, 13, 14, and 15 may be obtained. In a case where a light emitting gray scale level higher than the gray scale 15 needs to be input, the working gray scales 1, 2, 4, and 8 (as low gray scales in one period) may be input sequentially in an order of 1, 2, 4, and 8 in one period, and this process in one period is repeated until the desired light emitting gray scale level is obtained by superimposing the different working gray scales.

As can be known from the above operation process of the display panel, the number of times of writing the light emitting signals to the sub-pixels in the display panel (or the number of times of refreshing gray scale data) may be equal to the number of different working gray scale levels in the frame to be displayed. Therefore, the light emitting signals of corresponding durations corresponding to the light emitting gray scale levels are not required to be sequentially input to the sub-pixels.

By adopting the method for driving the silicon-based OLED display panel, the power consumption can be greatly reduced, and the brightness of the display panel can be improved.

It should be understood that, the above embodiments are merely exemplary embodiments employed to illustrate the principles of the present disclosure, and the present disclosure is not limited thereto. It will be apparent to those skilled in the art that various changes and modifications can be made therein without departing from the spirit and scope of the disclosure, and these changes and modifications are to be considered within the scope of the disclosure.

What is claimed is:

1. A silicon-based organic light emitting diode display panel, comprising:

a plurality of pixel islands, each of the plurality of pixel islands comprising a plurality of sub-pixels;

a plurality of control signal lines;

a plurality of switching signal lines;

a plurality of light emitting signal lines; and respective sub-pixel driving circuits for the plurality of sub-pixels, wherein the plurality of pixel islands are arranged in multiple rows and multiple columns, the plurality of sub-pixels in each of the plurality of pixel islands are of a same color, one sub-pixel in each of the plurality of pixel islands together with two sub-pixels of different colors in at least two adjacent pixel islands in a row or a column direction constitutes one pixel unit for displaying, each of the sub-pixel driving circuits comprises a first transistor, a second transistor and a first capacitor, a first electrode of the first transistor is connected to one of the plurality of switching signal lines, a second electrode of the first transistor is connected to a control electrode of the second transistor and a first terminal of the first capacitor, and a control electrode of the first transistor is connected to one of the plurality of control signal lines; a first electrode of the second transistor is connected to one of the plurality of light emitting signal lines, and a second electrode of the second transistor is connected to a first electrode of an organic light emitting diode to be driven; and a second terminal of the first capacitor is connected to a common voltage terminal, and under a control of switching signals provided from the plurality of switching signal lines and control signals provided from the plurality of control signal lines, working gray scale level signals corresponding to respective display gray scales are written to corresponding sub-pixels in an order from small to large in working gray scale sequentially by a plurality of times in one frame display time through the plurality of light emitting signal lines, wherein different working gray scale level signals indicate that the different working gray level signals have different durations, and each of the working gray scale level signals is provided to the organic light emitting diode via the second transistor through a light emitting signal line, and a final display gray scale of each of the plurality of sub-pixels in the plurality of pixel islands is a gray scale superimposed by the different working gray scale level signals.

2. The display panel of claim 1, wherein one first sub-pixel in each of the plurality of pixel islands is located at the same position in the pixel island as a second sub-pixel and a third sub-pixel of different colors respectively in at least two adjacent pixel islands in the row or column direction, so as to constitute one pixel unit.

3. The display panel of claim 2, wherein a distance between every two adjacent sub-pixels in the plurality of sub-pixels in each of the plurality of pixel islands is smaller than a distance between every two adjacent pixel islands in the plurality of pixel islands.

4. The display panel of claim 3, wherein a sub-pixel in each of the plurality of pixel islands further comprises the organic light emitting diode, the organic light emitting diode is provided with the first electrode, a light emitting functional layer, and a second electrode sequentially arranged on a side of the sub-pixel driving circuit away from a silicon substrate, and the first electrodes of the organic light emitting diodes of the sub-pixels in each of the plurality of pixel islands are spaced apart from each other by a distance in a range of 0.8 μm to 1.2 μm.

5. The display panel of claim 4, wherein the distance between two adjacent pixel islands in the plurality of pixel islands is in a range of 20 μm to 24 μm.

6. The display panel of claim 5, wherein each of the plurality of sub-pixels in the plurality of pixel islands has a size less than or equal to 3 μm*3 μm.

7. The display panel of claim 1, wherein the plurality of pixel islands at least comprise pixel islands of three different colors which have red sub-pixels, blue sub-pixels and green sub-pixels, respectively, and the pixel islands of the three different colors are sequentially arranged in the row direction, and the pixel islands of the same color are sequentially arranged in the column direction.

8. The display panel of claim 7, wherein the first electrodes of the second transistors in the plurality of sub-pixels in each of the plurality of pixel islands are respectively connected in parallel to a same light emitting signal line, and different pixel islands of the plurality of pixel islands are connected to different light emitting signal lines, respectively.

9. The display panel of claim 8, further comprising at least one light emitting signal bus line connected to the plurality of light emitting signal lines through a plurality of first gating switches, respectively.

10. The display panel of claim 9, further comprising a plurality of first gating lines connected to the plurality of first gating switches respectively, to control tune-on and turn-off of the plurality of first gating switches, respectively.

11. The display panel of claim 10, further comprising a plurality of second gating switches, wherein the plurality of light emitting signal lines are connected to the at least one light emitting signal bus line through one of the plurality of second gating switches and one of the plurality of first gating switches respectively, one of the plurality of first gating switches is between the at least one light emitting signal bus line and one of the plurality of second gating switches, and one of the plurality of first gating switches is connected to multiple light emitting signal lines connected to the pixel islands in one column in the plurality of pixel islands arranged in multiple rows and multiple columns through corresponding second gating switches, respectively.

12. The display panel of claim 11, further comprising a plurality of second gating lines connected to the plurality of second gating switches in a one-to-one correspondence respectively, to control turn-on and turn-off of the plurality of second gating switches, respectively.

13. The display panel of claim 1, wherein the plurality of control signal lines extend in the row direction, the plurality of switching signal lines extend in the column direction, the plurality of control signal lines cross over the plurality of switching signal lines to form a plurality of intersection regions in which the plurality of sub-pixels in the plurality of pixel islands are respectively located, and the plurality of control signal lines are configured to provide driving signals to multiple sub-pixel rows, respectively, and the plurality of switching signal lines are configured to provide switching signals to multiple sub-pixel columns, respectively.

14. A display device, comprising the display panel of claim 1 and a driving circuit for driving the display panel.

15. A method for driving the display panel of claim 1, comprising:

sequentially providing the control signals to sub-pixel rows in a plurality of pixel islands through the plurality of control signal lines respectively, and sequentially providing the switching signals to sub-pixel columns in the plurality of pixel islands through the plurality of switching signal lines respectively; and under a control of the switching signals provided from the plurality of switching signal lines and the control signals provided from the plurality of control signal lines, writing the working gray scale level signals corresponding to respective display gray scales to corresponding sub-pixels in an order from small to large in working gray scale sequentially by a plurality of times in one frame display time through the plurality of light emitting signal lines, different working gray scale level signals indicate that the different working gray scale level signals have different durations, and each of the working gray scale level signals is provided to the organic light emitting diode via the second transistor through a light emitting signal line, and the final display gray scale of each of the plurality of sub-pixels in the plurality of pixel islands is a gray scale superimposed by the different working gray scale level signals.

16. The method of claim 15, wherein the number of light emitting gray scale levels of each of the plurality of sub-pixels in the plurality of pixel islands is expressed as:

$$K=2^p$$

wherein K represents the number of the light emitting gray scale levels of a sub-pixel, p represents the number of working gray scale level signals input to the sub-pixel, and p is an integer larger than or equal to 0.

17. The method of claim 16, wherein the writing the working gray scale level signals corresponding to respective display gray levels to corresponding sub-pixels in an order from small to large in working gray scale sequentially by a plurality of times in one frame display time comprises: inputting the working gray scale level signals to the sub-pixels in the display panel in an order from small to large in working gray scale by a plurality of times, in each of which a working gray scale of M powers of 2 in the light emitting gray scale levels of $2^p$ is input where M is a integer from 0 to p−1, and controlling whether or not the working gray scale level signals are written into corresponding sub-pixels by the switching signals provided from the plurality of switching signal lines.

18. The method of claim 17, wherein the light emitting gray scale levels other than the working gray scales of M powers of 2 are acquired by superimposing the working gray scales of the M powers of 2 in the light emitting gray scale levels of $2^p$.

19. The method of claim 18, further comprising:

selecting p, and defining a period which comprises a total duration time for sequentially inputting all the working gray scale level signals in an order from small to large in working gray scale based on the light emitting gray scale levels of the selected p, and circularly inputting the working gray level signals of a plurality of periods to the corresponding sub-pixels to acquire the required gray scale.

20. The method of claim 19, wherein p=4.

* * * * *